United States Patent [19]

Armstrong

[11] Patent Number: 5,025,527

[45] Date of Patent: Jun. 25, 1991

[54] ESCALATOR CLEANING DEVICE

[75] Inventor: Graham A. W. Armstrong, Wagga Wagga, Australia

[73] Assignee: Advanced Escalator and Travelator Cleaner Pty. Ltd., New South Wales, Australia

[21] Appl. No.: 337,329

[22] Filed: Apr. 13, 1989

[51] Int. Cl.[5] ..... A46B 15/00

[52] U.S. Cl. ..... 15/256.5; 15/160; 15/246; 198/496

[58] Field of Search ..... 15/256.5, 104.92, 160, 15/302, 246, 50.1, 50.2, 320; 198/496; 134/6, 9

[56] References Cited

U.S. PATENT DOCUMENTS 870,633 11/1907 Lewis ..... 15/50.2

1,028,527 6/1912 Ballard ..... 15/50.2

3,869,749 3/1975 London et al. ..... 15/50 C 4,514,872 5/1985 Hopkins ..... 15/256.5

4,664,719 5/1987 Mizutani ..... 15/256.5 X

FOREIGN PATENT DOCUMENTS 0002889 1/1978 Japan ..... 15/160

*Primary Examiner*—Edward L. Roberts

*Attorney, Agent, or Firm*—Edwin D. Schindler

[57] ABSTRACT

An escalator cleaning device is disclosd having a brush adapted to cover the tread of an escalator and a frame for supporting the brush. The cleaning device is further constructed so that the frame can engage the side walls of an escaltor in order to support the cleaning device in place during use.

5 Claims, 2 Drawing Sheets

ESCALATOR CLEANING DEVICE

FIELD OF THE INVENTION

This invention relates to cleaning devices, more particularly to devices for automatically cleaning escalators, travelators, hereinafter reference being made for convenience to escalators only.

DESCRIPTION OF THE PRIOR ART

Presently, cleaning of escalators is a difficult, expensive and inconvenient task, requiring escalators to be temporarily taken out of service and cleaned manually. This is time consuming, laborious and expensive.

SUMMARY OF THE INVENTION

The present invention overcomes this problem broadly by providing an escalator cleaning device comprising brush means adapted to cover the tread of an escalator, frame means supporting said brush means, and means on said frame means to engage the side walls of said escalator whereby to support said device in place.

BRIEF REFERENCE TO THE DRAWINGS

A better understanding of the invention can be gained by reference to the accompanying drawings in which.

DETAILED DESCRIPTION OF THE DRAWINGS

Figure 1:
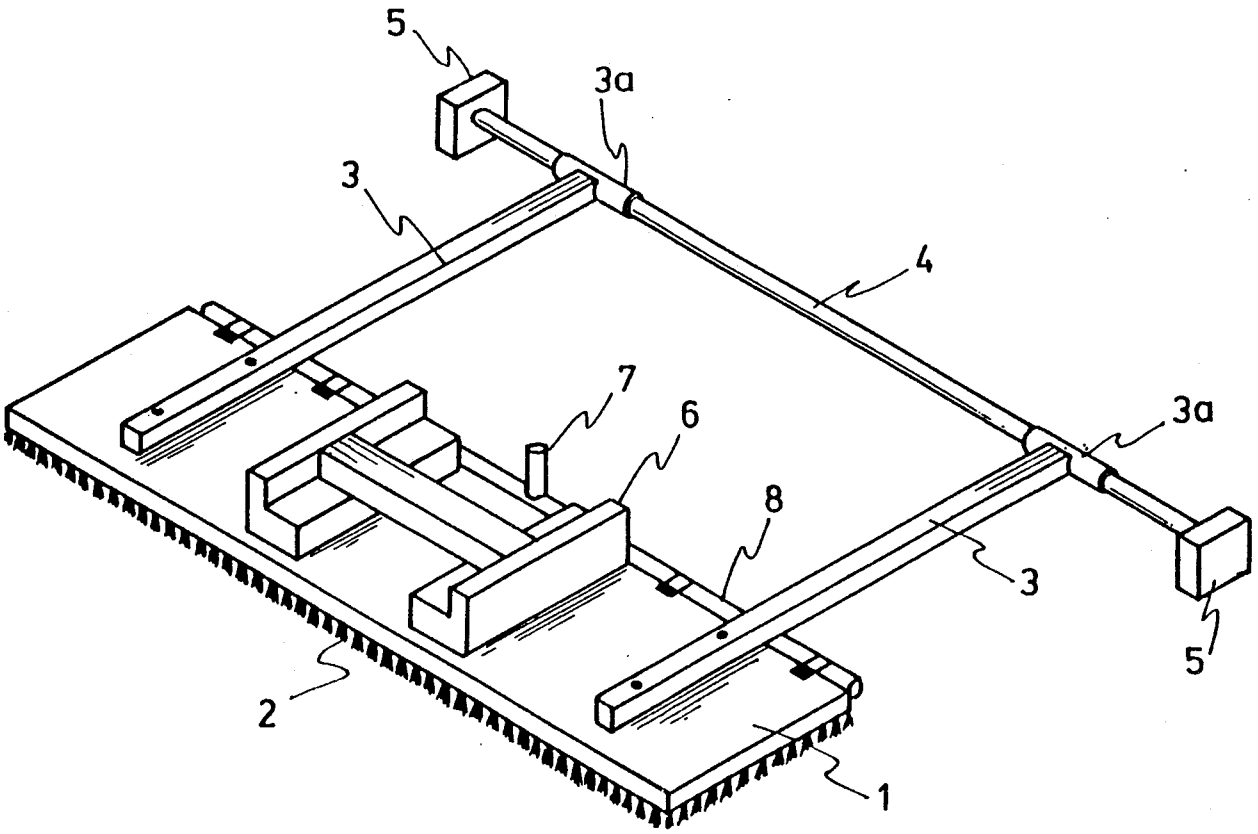
FIG. 1 is a perspective view of the cleaning device of the invention.

In the drawings is shown an automatic escalator cleaning device having a flat platform like portion 1, equipped with bristle or brush means 2 underneath. The preferred bristle types are marketed under the trade name TYNEX which is a nylon bristle including metallic chips or fibers. A frame is used to clamp platform 1 in place on an escalator between the side walls thereof.

Figure 3:
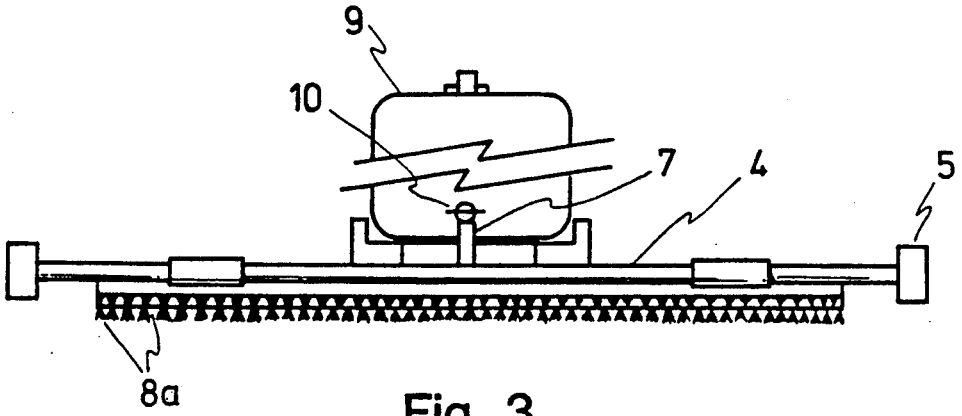
FIGS. 3 and 4 are respectively end and side elevation views.
Figure 2:
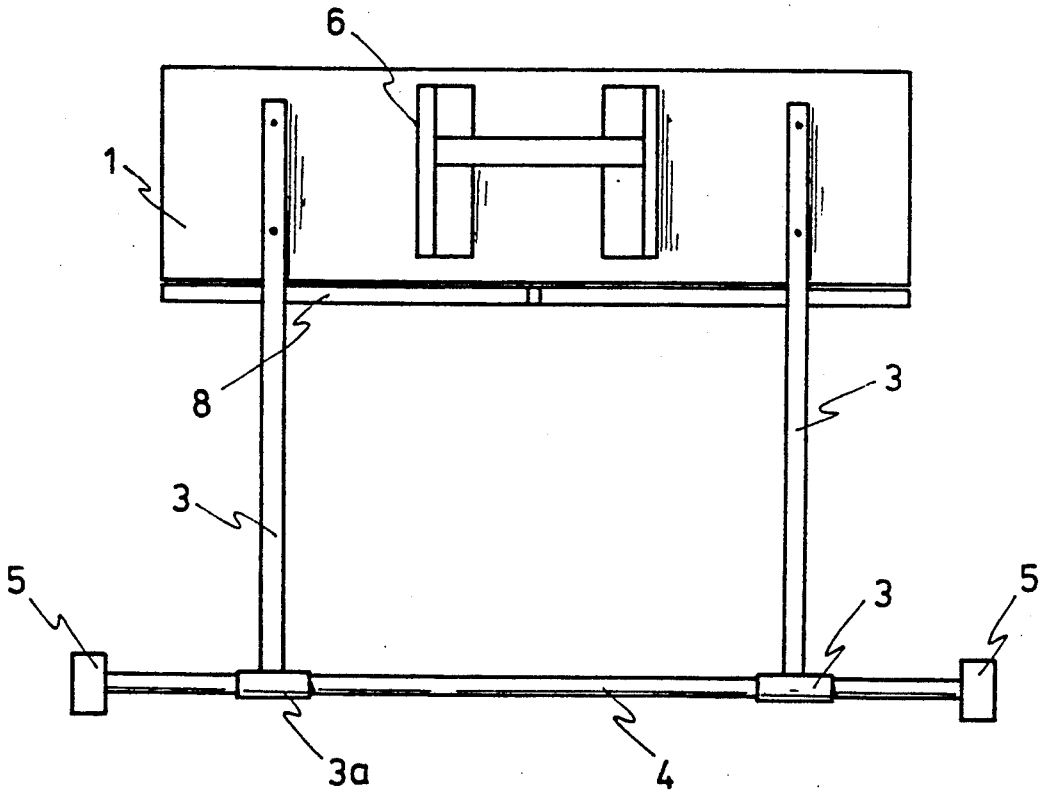
FIG. 2 is a plan view of said device.
Figure 4:
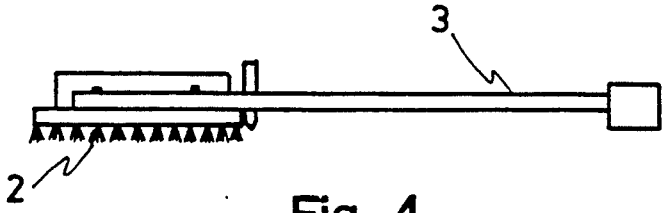

The frame comprises a pair of arms 3, connections 3*a* , a bar and a pair of end blocks 5 mounted on the bar. A frame 6 on platform 1 holds a container 9 which may be filled with a liquid cleaning mixture, e.g. detergent and water. A distributor system for the cleaning mixture comprises pipe means 7 and 8. Pipe means 7 receives the cleaning mixture from container 9 which is provided with valve means 10 (FIG. 3) to control the flow in the pipe means, and then through a series of ample holes in pipe means 8, designated 8*a* (FIG. 3).

In use the device is fitted to an escalator by placing the platform portion over a tread thereof and fixing in place by member (bar) 4 and blocks 5 between the side walls. Blocks 5 may be constructed of wood, hard rubber, or plastic material. In any event, it is preferred that they should have at least a minimal resilience to avoid damage to said side walls. The connectors 3*a* may be slideable and clampable to assist adjustment to bar 4. As an alteration, bar 4 might be telescopically adjustable. To clean the escalator, the escalator is run while the device is fitted, with the cleaning mixture adjusted to a convenient rate of flow. Rubbish is brushed off the treads and is collected (as usual) in hopper means under the escalator.

Finally, it is not necessary that there be means 6 and 9 on the device; a hose supply can be connected directly to pipe means 7 and 8, from a water supply or means providing the cleaning liquid mixture.

Some of the bristles 2 (say every 4th or 5th set) may be shortened somewhat whereby contact with the tread is still effected. Furthermore the side bars (arms 3) may be located closer together than is shown in the diagrams. They may be provided with legs whereby the side bars are held to the broom more firmly.

It must be emphasized that this invention is to be given a broad connotation and is not limited to the embodiments specifically disclosed.

I claim:

1. An escalator cleaning device, comprising:

brush means adapted to cover a tread of an escalator:

frame means supporting said brush means;

engaging means on said frame means to engage side walls of said escalator for supporting in place said escalator cleaning device; and, pipe means adapted to be connectable to a source of liquid for cleaning said escalator, said pipe means being arranged along an edge of said brush means which is first contacted by the tread of the escalator to distribute the liquid in use to the underside of said brush means.

2. The escalator cleaning device according to claim 1, wherein said brush means includes platform means with downwardly projecting bristle means affixed below.

3. The escalator cleaning device according to claim 2, wherein said frame means includes a bar adapted in use, to extend transverse of the direction of movement of the escalator including resilient contact means on the ends of said bar to engage said side walls.

4. The escalator cleaning device according to claim 2, further comprising means on said platform means having a self-contained source adapted to hold a cleaning liquid mixture, and means for connecting said self-contained source to said pipe means.

5. The escalator cleaning device according to claim 1, wherein said frame means includes a bar adapted in use, to extend transverse of the direction of movement of the escalator including resilient contact means on the ends of said bar to engage said side walls.

* * * * *